US009458706B2

(12) United States Patent
Page, Jr.

(10) Patent No.: US 9,458,706 B2
(45) Date of Patent: Oct. 4, 2016

(54) METHOD OF LIFTING OIL FROM A WELL

(71) Applicant: John Splawn Page, Jr., Coeur D Alene, ID (US)

(72) Inventor: John Splawn Page, Jr., Coeur D Alene, ID (US)

( * ) Notice: Subject to any disclaimer, the term of this patent is extended or adjusted under 35 U.S.C. 154(b) by 254 days.

(21) Appl. No.: 13/783,153

(22) Filed: Jul. 26, 2013

(65) Prior Publication Data

US 2015/0027698 A1 Jan. 29, 2015

(51) Int. Cl.

| | |
|---|---|
| ***E21B 43/12*** | (2006.01) |
| ***E21B 34/08*** | (2006.01) |
| ***E21B 43/20*** | (2006.01) |
| *F04B 25/02* | (2006.01) |
| *F04B 5/02* | (2006.01) |

(52) U.S. Cl.

CPC ..... *E21B 43/129* (2013.01); *E21B 34/08* (2013.01); *E21B 43/20* (2013.01); *F04B 5/02* (2013.01); *F04B 25/02* (2013.01)

(58) Field of Classification Search

CPC ..... E21B 21/12; E21B 23/04; E21B 34/08; E21B 43/129; E21B 43/20; F04B 5/00; F04B 5/02; F04B 25/02; F04B 35/008; F04B 47/04

See application file for complete search history.

(56) References Cited

U.S. PATENT DOCUMENTS

| | | | | |
|---|---|---|---|---|
| 1,544,898 | A * | 7/1925 | Gage | F04B 47/04 417/392 |
| 2,090,676 | A * | 8/1937 | Hallgarth | F04B 47/04 91/310 |
| 2005/0150224 | A1* | 7/2005 | Hoffarth | F04B 47/08 60/533 |
| 2009/0285700 | A1* | 11/2009 | Corbeil | F04B 47/08 417/390 |

* cited by examiner

*Primary Examiner* — Giovanna C Wright

(57) ABSTRACT

A submersible pump for oil wells that is attached to two strings of tubing that are run into a well. One is for injection of water down to the pump and the other is for producing oil from the well. The pump has a reciprocating piston that will suck in oil and discharge it at a higher pressure and push it up to the surface. This happens simply by pouring water at zero pressure into the injection tubing at the surface. This results in a hydrostatic pressure in the bottom that tubing. A directional switching control valve alternately directs the hydrostatic pressure to one side of a piston and then the other side of the piston in the pump thereby utilizing the energy with just the weight of the water to operate it. The directional switching valve first receives the hydrostatic pressure and diverts it to the pump chambers alternately. No pumping jack is needed no sucker rods are needed, no electricity is needed. There must be water available to be funneled into the tubing to cause it to pump. The water is left in the well.

1 Claim, 2 Drawing Sheets

Fig 1
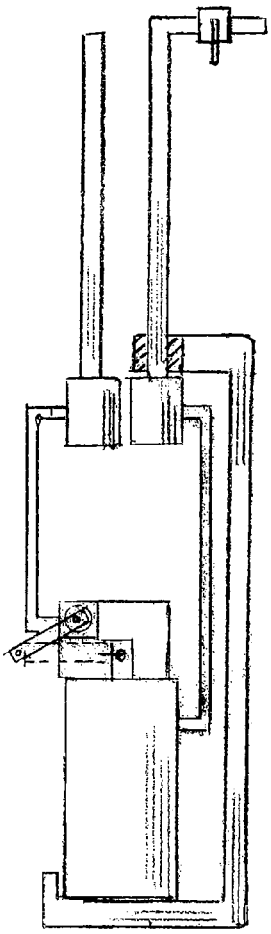
Fig 2
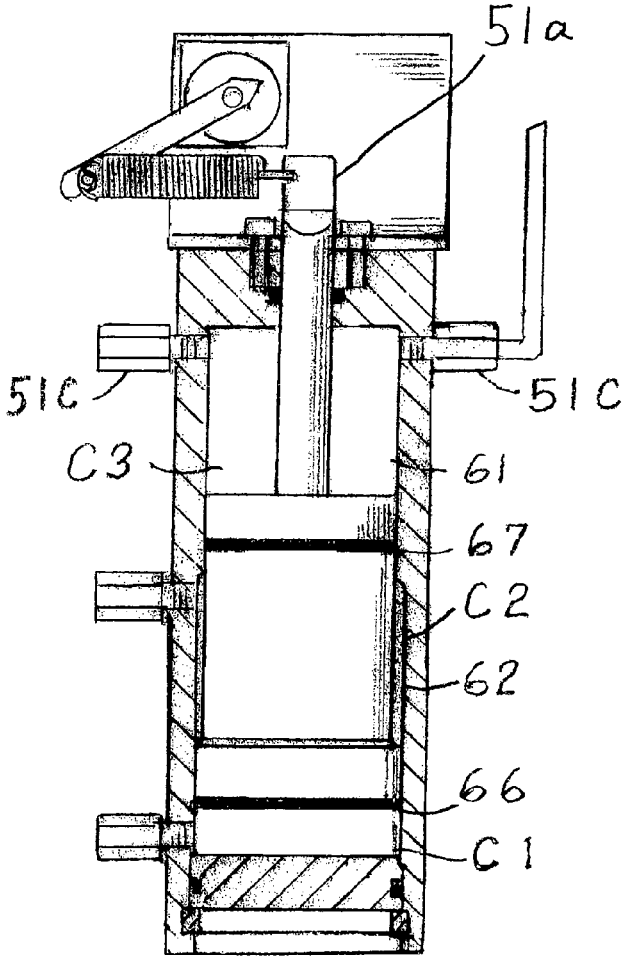
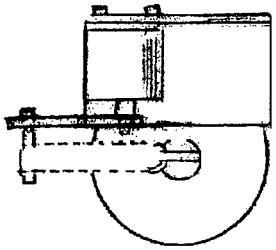
Fig 3

METHOD OF LIFTING OIL FROM A WELL

BACKGROUND

Stripper Wells

A stripper well or marginal well is an oil or gas well that is nearing the end of its economically useful life. "Stripper well" or "marginal well" are terms generally used to describe wells that produce natural oil at very low rates—less than 10 barrels per day of oil. With the price of crude oil spiraling upward an interest in reclaiming untapped reserves in these stripper wells is becoming a topic of renewed interest.

In the United States of America, one out of every six barrels of crude oil produced comes from a marginal oil well, and over 78 percent of the total number of U.S. oil wells are now classified as such.

There are over 400,000 of these wells in the United States, and together they produce nearly 900 thousand barrels of oil per day, 16 percent of U.S. Production.

There are thousands of wells that don't have enough potential production to justify the operating cost of the conventional pumping jack with rods and tubing and these are the wells that applicant's new method could help strip out a little more oil.

SUMMARY

One of the major objects of applicant's invention is to provide a down hole pumping device that will produce small amounts of oil from stripper wells with a minimum of operating expenses and equipment investment.

The most common current method of lifting oil from a well utilizes solid rods and a pump installed at the bottom of the inside of the tubing that hangs in the well casing. A pumping unit with a power source is connected to the rod-string, which lifts the rods and the pump plunger lifting oil to the surface. This method has been used for many years. Applicant's method eliminates the rod-string as well as the powered pumping unit at the surface.

That new method has a pump attached to the bottom portion of the outside of a string of tubing. A second string of tubing is run along side the first tubing string. This second tubing provides the power to run the pump when water is poured into it. The hydrostatic pressure of the water powers the pump. Simply adding enough water into the second tubing string will build up a hydrostatic pressure at the pump and cause the pump to start pumping.

Water in a vertical column weighs 0.43 pounds per square inch for each vertical foot of height so a well 1,000 ft deep will have a hydrostatic pressure of 430 psi and if it is salt water it is 0.44 psi and a 1,000 ft well the pressure would be 440 psi. That is the pressure in the tubing that carries water down to the pump. The pressure in the tubing that carries the oil back up to the surface will be different because the weight of the oil is less than water. Oil is 0.333 PSI for every foot of vertical height in the tubing. In order to lift the oil by using a pump, it requires that the pump have a higher discharge pressure than its input pressure.

This higher fluid pressure is necessary for moving the oil up to the surface because that hydrostatic pressure of 0.333 psi for every foot of vertical height would exert a force back down on the pump's small piston. The pump is designed to increase its discharge pressure by 43%.

Lifting oil from a well utilizing the hydrostatic pressure in a tubing string to power a pump is a whole new method.

A directional switching control valve directs the water pressure to the operating chambers of the pump. To stop the pump, simply close the valve on the output tubing string at the surface or stop putting water in the input tubing string. This will result in there not being enough water pressure to operate the pump. The water that is put into the well stays in the well.

Based only on cubic inch displacement of the pump the ratio of water into the well compared to the amount of oil returned should be about three gallons of water into a well to get a return of two gallons of oil. If part of the production is water or gas then there will be less oil returned.

There are hydraulic lines connecting this second tubing string to the pump and directional switching control valve. The piston in the pump has a small rod 51*a* connected to it and it extends out through a hole in the end of the pump body. It's function is to make contact with the directional switching control valve. The directional switching control valve is connected to this rod by way of a spring and when the piston in the pump gets to the end of its stroke, the rod pulls on the spring to trip the directional switching control valve to redirect the water pressure to a middle chamber of the pump that pushes the piston back to the beginning of the power stroke. On this back stroke of the piston, oil is sucked in from the well into the upper chamber through a check valve. Then when the lower chamber receives the water pressure, it pushes the oil that has been sucked into the upper chamber up through the output tubing string up to the surface.

This upper chamber has ports for fluid to enter and exit it. There are check valves installed into said ports for the entrance and the exit of oil into and out of the upper chamber. One check valve prevents fluid from leaving the chamber but allows fluid to enter the chamber. The other check valve allows fluid to leave the chamber but does not allow fluid to flow back into the chamber.

When the pump's piston moves backwards it sucks oil into that upper chamber past the check valve thereby filling the chamber with oil and then when pressure is applied to the large end of the piston it displaces that fluid out of that upper chamber through a check valve and up through tubing to the surface. The output tubing string has a valve connected to it at the surface. This valve controls the amount of oil that is produced from the well. It also controls the rate of reciprocation of the piston in the body of the pump.

There is also an adapter on the end of the input tubing string that takes water from within it out through a port into small tubing that is connected to the directional switching control valve.

There is also an adapter on the end of the output string of tubing that brings oil back to the surface. It has enough wall thickness to allow drilling and tapping for a tubing fittings to be installed and then be connected to the discharge ports the pump.

When the directional switching control valve directs the water to the pump's lower chamber and piston, it causes it to move to the end of it's stroke and then when the directional switching control valve is tripped by the rod, the water is directed to the middle chamber of the pump and it causes the piston to move back to its original position.

In old wells that may not have any tubing in them and new tubing has to be purchased to use this new method, then small tubing such as 1¼ inch would be sufficient and would be less expensive than the normal 2 inch or 2½ inch tubing. The input string of tubing could be ⅜ inch or ½ inch stainless steel tubing strapped to the 1¼ inch tubing. The 1¼ inch tubing would be the best tubing to bring the crude oil up from the well to the surface because it will be steel which can rust if water runs through it. The input tubing string should be stainless steel because it would be conducting the water down to the pump.

BRIEF DESCRIPTION OF DRAWINGS

FIG. 1 shows a schematic assembly of the pump, valve and the 2 strings of tubing. It shows a pump attached to the bottom of and on the outside of a string of tubing. A second string of tubing is run in along side of the first tubing string.

FIG. 2 shows more details of the pump when the directional switching control valve is attached to the pump. It shows the three different chambers and a hydraulic connector for entrance in to each one of them numbered as C1, C2, and C3.

FIG. 3 is a plan view looking down on the directional switching control valve mounted on the pump body with the spring connection between the two of them.

DETAILED DESCRIPTION OF DRAWINGS

Figure 4:
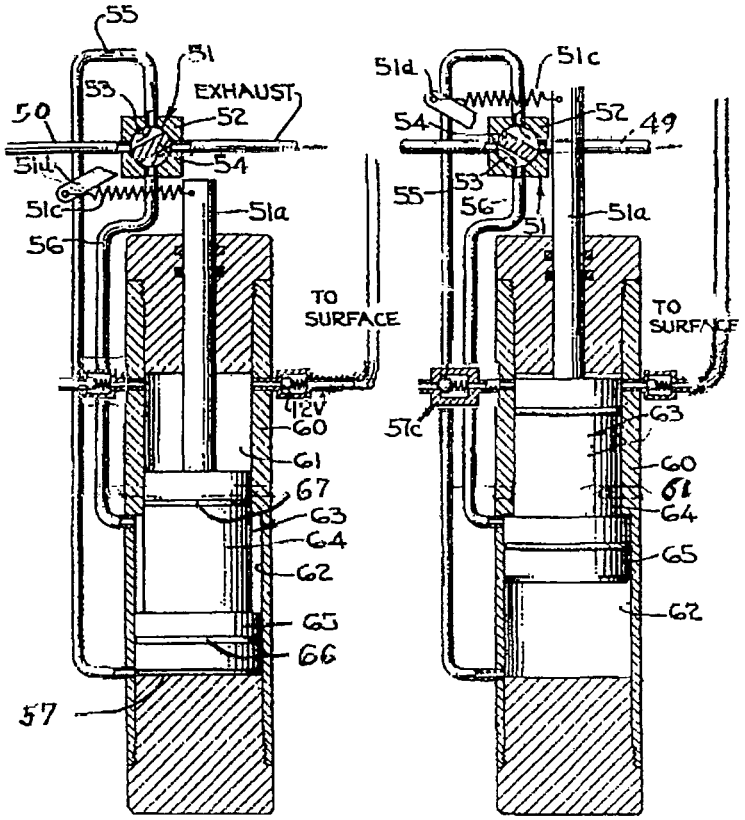
FIG. 4 is a section view and schematic view of the invention showing the piping to the three different chambers in the pump and the direction of fluid flow

FIG. 1 shows a schematic assembly of the pump, valve and the 2 strings of tubing. It shows a pump attached to the bottom of and on the outside of a string of tubing.

A second string of tubing is run in along side of the first tubing string. This second tubing provides the power to run the pump when water is poured into it. The weight of the water, the hydrostatic pressure of the water powers the pump.

FIG. 1 does not show all of the hydraulic line connections. It merely shows the approximate position of the adapters on the two strings of tubing, the location of the pump and control valve. FIG. 4 does show the details of the piping to and from the directional switching control valve to the pump.

FIG. 2 shows that pump body has two different inside diameters. The smaller diameter at 61 and the larger diameter at 62 and a piston with two different diameters that fit into the body and they carry seals on each of its different diameters. One seal is sealing on the large diameter of the piston and it forms a lower chamber when all parts are assembled. Another seal is sealing on the smaller diameter of the piston thereby leaving an empty space that forms a middle chamber between the two seals. When pressure is applied into the pump against the large diameter piston it creates a greater pressure to the fluid that has been sucked into the upper chamber and it forces the fluid out and up to the surface.

When that pressure is vented from that lower chamber and fluid pressure is directed to the middle chamber of the pump and it pushes the piston back to its starting point.

This upper chamber has ports for fluid to enter and exit it. There are check valves 51*c* for the entrance and the exit of oil into it. One check valve prevents fluid from leaving the chamber but allows fluid to enter the chamber. The other check valve 51*c* allows fluid to leave the chamber but does not allow fluid to flow back into the chamber.

When the pump's piston moves backwards it sucks oil into that upper chamber past the check valve thereby filling the chamber with oil and then when pressure is applied to the large end of the piston in the lower chamber it displaces that fluid out of that upper chamber through a check valve and up through the tubing to the surface.

The output tubing that returns fluid to the surface has a valve on it at ground level. This valve controls the amount of oil that is produced from the well. It also controls the rate of speed of the strokes per minute of the piston in the body of the pump. It also controls the rate of reciprocation of the piston in the body of the pump.

Limiting the flow of production through this valve slows the speed of reciprocation of the pump. It will allow the operator to run the pump just fast enough to skim off the amount of oil the well can produce.

The hydrostatic water pressure from the tubing that is filled with water enters the control valve 51 through line 50 and it shows the control valve 51 open to flow of the fluid through it and passing through into line 55 which goes down to the bottom of the pump into chamber 57 which is the large end of the piston.

Notice in FIG. 2 that the inside diameter of the cylinder 60 at 62 is larger than the inside diameter of the cylinder at 61. There is a step down there in the diameter and there is a seal 67 sealing on that smaller diameter. The seal 66 is sealing in the larger diameter and the space in between those two seals is a chamber for the water pressure to enter and push back on the piston when the piston reaches the end of its stroke.

The water pressure pushes the piston up to the end of the stroke as shown in the schematic on the right side and it shows the piston in the up position and it shows the control valve 51 with the flow going from line 50 down in through line 56 to the middle chamber between the seal 66 and 67. The schematic on the right shows the line 55 being exhausted out through line 49. This pump is a differential pump because the piston head 65 is larger than the piston 63 at the other end. This results in a boosted pressure in the chamber 61 and that fluid is discharged through the check valve and the line that goes to the surface.

The invention claimed is:

1. An assembly operable for lifting fluid from a well comprising a booster pump, a directional switching control valve; an input string of tubing suspended in a well casing bore; an output string of tubing suspended in said well casing bore; a frame attached to said input tubing string or said output tubing string configured to hold said pump in place below said input or output strings of tubing; said pump has a tubular body with two different inside diameters; a piston with two different outside diameters fits into said tubular pump body and said piston is one long piece but near the middle of the length the piston is stepped down to a smaller diameter; two seals are mounted on the piston, one on each of the two different diameters; each end of the tubular body is closed off resulting in three chambers within the pump body; the three chambers comprise a lower chamber, a middle chamber and a upper chamber; the lower chamber houses the end of the piston that has a larger diameter so the larger end of the piston has more surface area for fluid pressure to push on than the smaller end of the piston; the middle chamber receives fluid pressure to force the piston back down to the bottom of the lower chamber; the upper chamber is where the smaller end of the piston reciprocates; a rod is attached to the piston on the smaller end and extends out through a hole in the closed end of the pump body where the rod engages said directional switching control valve; the pump body has ports adapted for tubing to be connected to them; a first one of said ports has fittings and tubing to connect the first port to the input string of tubing that conducts water down into the well to said directional switching control valve; a second one of the said ports has fittings and tubing to connect the second port to the middle chamber of the pump; a third port has fittings and tubing to connect it to the lower chamber of the pump where the larger end of the piston reciprocates; a fourth port is always open to exhaust the pressure from the lower and middle chambers as they are alternately pressured and exhausted as the pump reciprocates; two check valves are installed into the wall of the upper chamber, the first check valve allows oil to pass through and enter the chamber but checks and prevents the oil in the chamber from passing back through; the second check valve is attached to the upper chamber wall and allows oil to pass out of the upper chamber but prevents oil from coming back through into the upper chamber; when the well fluid leaves the later check valve the fluid passes through tubing which is connected to the output string of tubing which brings the well fluid up to the surface.

* * * * *